United States Patent [19]

Matthews

[11] 3,955,910

[45] May 11, 1976

[54] SELF-CHECKING AUTOMATIC PILOT FUEL IGNITION SYSTEM

[75] Inventor: Russell Byron Matthews, Goshen, Ind.

[73] Assignee: Johnson Service Company, Milwaukee, Wis.

[22] Filed: Sept. 23, 1974

[21] Appl. No.: 508,418

[52] U.S. Cl. ..... 431/25; 431/66; 431/71

[51] Int. Cl.[2] ..... F23Q 3/00

[58] Field of Search ..... 431/25, 46, 69, 71, 431/66, 45

[56] References Cited

UNITED STATES PATENTS

| | | | |
|---|---|---|---|
| 3,441,356 | 4/1969 | Walbridge | 431/66 |
| 3,767,354 | 10/1973 | Wright | 431/71 X |
| 3,914,092 | 10/1975 | Matthews | 431/66 |

*Primary Examiner*—Edward G. Favors
*Assistant Examiner*—Harold Joyce
*Attorney, Agent, or Firm*—Johnson, Dienner, Emrich & Wagner

[57] ABSTRACT

A pilot fuel ignition system including an ignition circuit for generating sparks for igniting fuel emanating from a pilot burner to establish a pilot flame, a control circuit responsive to the ignition circuit to operate a pilot valve to supply fuel to the pilot burner, and a sampling circuit controlled by the control circuit to maintain the pilot valve operated and to operate a main burner valve to supply fuel to a main burner for ignition by the pilot flame. A flame sensing circuit enabled whenever a pilot flame is established normally disables the ignition circuit, but periodically enables the ignition circuit to test the operability of the ignition circuit. Failure of the ignition circuit to operate results in the disabling of the sampling circuit causing shutoff of the pilot and main burner valves. Also, a warp switch energized whenever the pilot flame is extinguished effects shutoff of the pilot valve interrupting the supply of fuel to the pilot and the main burners.

20 Claims, 1 Drawing Figure

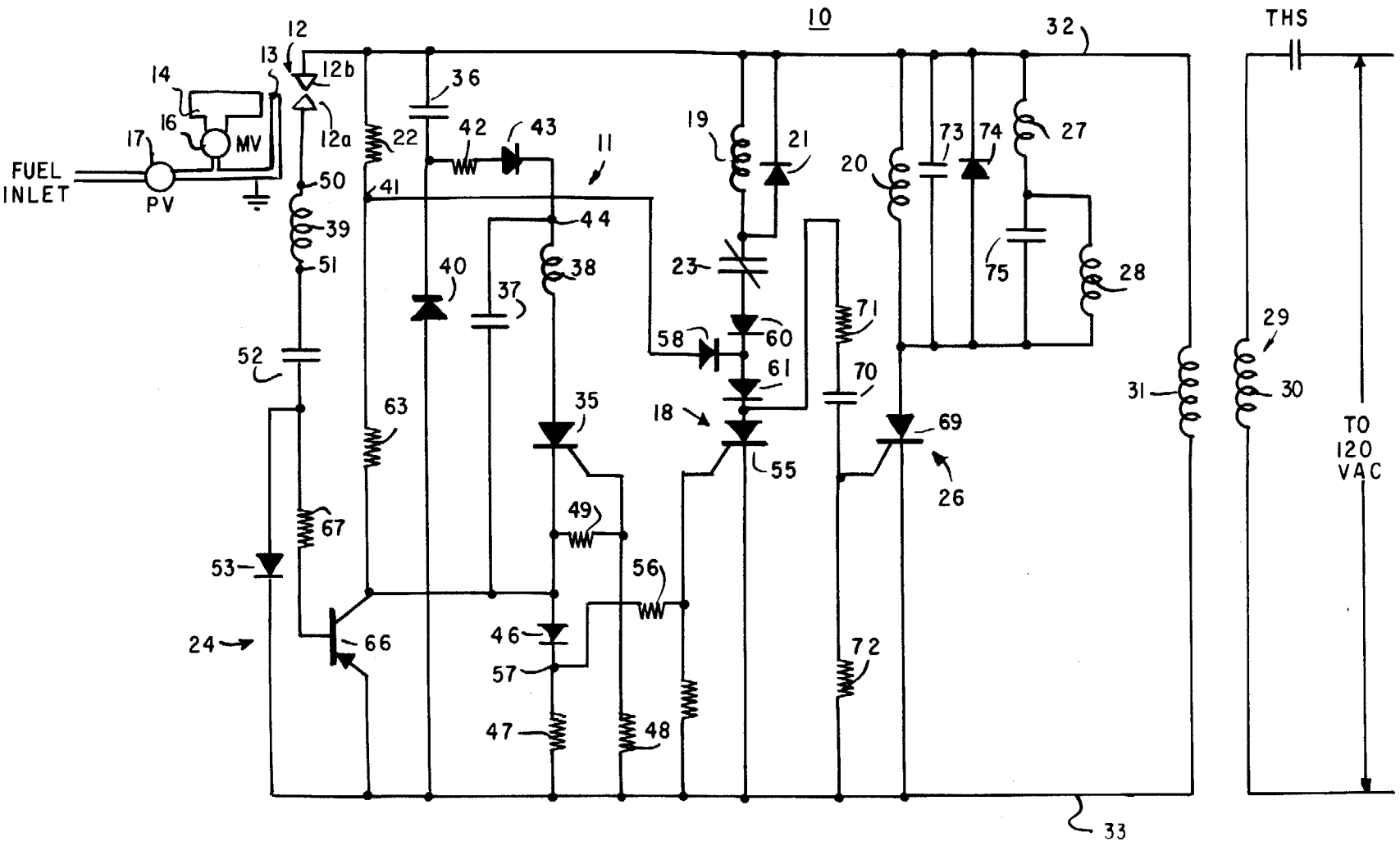
TO 120 VAC
THS
FUEL INLET
MV
PV

SELF-CHECKING AUTOMATIC PILOT FUEL IGNITION SYSTEM

BACKGROUND OF THE INVENTION

1. Field of the Invention

This invention relates to automatic fuel ignition systems, and more particularly, to a fail-safe, proven pilot ignition system providing automatic shutoff of fuel supply to pilot and main burner sources in the event of loss of pilot flame or ignition sparks.

2. Description of the Prior Art

Many manual and automatic fuel ignition systems have been proposed in the prior art. In manual ignition systems, for example, ignition of a pilot fuel is accomplished by manually operating a valve of the pilot source to permit fuel from a pilot source to be ignited. Once a pilot flame is established, the continued presence of the pilot flame is sensed by a thermocouple to enable the pilot valve to remain operated.

At the present time, many existing manually operated pilot sources are being converted to provide automatic operation. Such conversion generally requires the addition of two pair of electrodes to the system, one pair of electrodes for igniting the fuel and another pair of electrodes for sensing the presence of the pilot flame. Such electrodes must be positioned adjacent the outlet of the pilot source in the space provided for the thermocouple. However, in existing pilot burner apparatus, it is generally not possible to physically locate two pair of electrodes in the space provided for the thermocouple. Therefore, it would be desirable to provide an automatic fuel ignition system which requires only a single pair of electrodes to provide both fuel ignition and flame sensing functions so that such electodes may be located in the space provided for the thermocouple in existing pilot burner apparatus.

Although automatic fuel ignition systems are more desirable than manual systems from the convenience standpoint, automatic systems require means for automatically controlling the shutoff of the supply of fuel to the pilot and main burners in the event of flame out. For example, many automatic systems employ a warp switch which is operable in the event of a flame out to effect shutoff of the supply of fuel to the pilot burner whenever ignition sparks provided by the spark generating circuit fail to establish a pilot flame within a predetermined time. However, if the warp switch is inoperative due to an open circuit condition of the warp switch heater circuit, for example, failure of the warp switch to operate will enable the fuel to be supplied to the pilot burner until the ignition spark circuit is enabled to generate ignition sparks and until reignition of the pilot flame occurs.

In addition, if the ignition spark generating circuit malfunctions such that ignition sparks are not provided when required, fuel emanating from the pilot source is wasted. Accordingly, it would be desirable to have an automatic fuel ignition system which automatically checks the operability of the warp switch and the ignition spark generating circuit. It would also be desirable to have an automatic fuel ignition system which effects total shut down of the fuel supply to the system in the event of loss of pilot flame or loss of ignition sparks.

SUMMARY OF THE INVENTION

It is therefore an object of the present invention to provide an automatic fuel ignition system which provides total shutoff of fuel to the system in the event of loss of pilot flame or loss of ignition sparks.

Another object of the invention is to provide an automatic fuel ignition system which employs a single pair of electrodes for both igniting the fuel and sensing the presence of the resultant flame.

A further object of the invention is to provide an automatic fuel ignition system which periodically tests the operability of the ignition spark generating circuit.

Yet another object of the present invention is to provide an automatic fuel ignition system wherein a warp switch is operable to effect total shutoff of fuel to the system in the event of loss of flame and wherein the operability of the warp switch is periodically proven.

In accordance with an exemplary embodiment, the automatic fuel ignition system includes a pulse generating means for applying high voltage pulses to a pair of electrodes which are positioned adjacent an outlet of a pilot source. The high voltage pulses applied to the electrode means effect the generation of ignition sparks between the electrodes for igniting fuel emanating from the pilot source whenever a pilot valve means of the pilot source is energized. A control means controlled by the pulse generating means effects energization of the pilot valve means.

The electrodes are connected in a sensing circuit means to sense the presence of the pilot flame. Only one pair of electrodes are employed to both enable ignition of the pilot fuel and sensing of the pilot flame. Accordingly, the electrodes can be substituted for the thermocouple in an existing pilot burner apparatus permitting conversion of the existing unit from manual to automatic operation without additional space requirements.

The sensing means includes switching means enabled whenever a pilot flame is established to normally disable the pulse generating means and the control means. Once the pilot flame is established, the sensing means periodically enables the pulse generating means and the control means to permit testing of the operability of the pulse generating means. A sampling circuit means controlled by the control means maintains the pilot valve means energized whenever the pilot flame is established. The sampling means also effects energization of a main burner valve means of a main burner source whenever the pilot flame is established. The continued operation of the sampling means to maintain the pilot valve means and the main burner valve means operated is dependent upon the periodic enabling of the pulse generating means by the sensing means. Accordingly, whenever the pulse generating means fails to operate during a given sampling period, the main burner valve means and the pilot burner valve means are deenergized, providing total shutoff of fuel to the system.

In the event of loss of pilot flame, the sampling means is disabled to deenergize the main burner valve means. The pilot valve means is maintained energized by the control means during reignition of the pilot flame.

The pulse generating means further includes warp switch means operable to deenergize the pilot valve means whenever the pulse generating means fails to reignite the pilot flame within a predetermined time. The pilot valve means is connected in series with the main burner valve means such that fuel to the main burner passes through the pilot valve means. Accordingly, deenergization of the pilot valve means also cuts off the supply of fuel to the main burner effecting total shutoff of fuel to the ignition system.

The warp switch heater is connected in an enabling circuit of the pulse generating means and accordingly, continuity of the warp switch heater is assured whenever the pulse generating means is operating. In the event of an open circuit condition for the warp switch heater, the pulse generating means is disabled, and such condition is determined by the sampling means which effects shut down of the supply of fuel to the system.

Thus the fuel ignition system of the present invention is fail-safe in all respects and responds to the two major failures which are loss of spark and loss of pilot flame. The system responds to loss of spark for any reason, including leakage across the electrodes by way of the sampling means which effects total shutoff of the supply of fuel to the system. The system responds to loss of pilot flame through the operation of the warp switch which also effects total shutoff of fuel to the system. In addition, the system of the present invention is self-checking in that the operation of the pulse generating means and the continuity of the warp switch are periodically tested to assure proper operation thereof.

DESCRIPTION OF A PREFERRED EMBODIMENT

General Description

Referring to the drawing, there is shown a schematic circuit diagram of the self-checking pilot fuel ignition system 10 provided by the present invention. The pilot fuel ignition system 10 includes a pulse generating circuit indicated by reference character 11 which produces pulses for effecting the generation of ignition sparks between a pair of ignition electrodes 12. The ignition sparks ignite fuel emanating from an outlet 13 of a pilot burner 14 to establish a pilot of flame. The pilot flame in turn ignites fuel emanating from a main fuel burner 15.

The pilot fuel ignition system 10 further includes a control circuit 18 responsive to the pulses produced by the pulse generating circuit 11 to effect energization of a pick-up winding 19 of a pilot valve 17 for operating the pilot valve 17. When the pilot valve 17 is open, fuel flows to the pilot burner 14 to permit ignition of the fuel by the ignition sparks to establish the pilot flame.

A sampling circuit 26 controls the energization of a hold winding 20 of the pilot valve 17 and a pick-up winding 27 and a hold winding 28 of the main burner valve 16. The control circuit 18 enables the sampling circuit 26 whenever the pulse generator circuit 11 is functioning properly.

The control circuit 18 also effects energization of a warp switch heater 22 which has associated contacts 23 for enabling deenergization of the pick-up winding 19 of the pilot valve 17 in the event of loss of pilot flame whenever the ignition sparks fail to ignite the fuel within a predetermined time. As shown in the drawing, the pilot valve 17 is connected in series with the main burner valve 16 so that the main burner fuel passes through the pilot valve 17 from the fuel source. Accordingly, closing of the pilot valve 17 also interrupts the flow of fuel to main fuel burner 15.

The ignition electrodes 12 are also used to sense the presence of the pilot flame. To this end, the ignition electrodes 12 are connected in a sensing circuit 24. Whenever the pilot flame is established, the sensing circuit 24 normally disables the pulse generating circuit 11 and a control circuit 18. The sensing circuit 24 periodically enables the pulse generating circuit 11 and the control circuit 18 during sampling periods defined by the sensing circuit 24 whenever a flame is established. The periodic enabling of the control circuit 18 enables the sampling circuit 26 to maintain the main burner valve 16 and the pilot valve 17 operated. If however, the pulse generator circuit 11 should fail for any reason such that ignition sparks are not being generated, the sampling circuit 26 effects deenergization of both the main burner valve 16 and the pilot valve 17 providing total shutoff of the supply of fuel to the ignition system 10.

The disabling of the control circuit 18 also serves to limit current flow through the warp switch heater 22 and winding 19 of the pilot valve 17. Accordingly, heating of the warp switch heater 22 is negligible whenever the pilot flame is established. Also, the average current through the pick-up winding 19 of the pilot valve 17 is maintained at a low value.

DETAILED DESCRIPTION

Power is supplied to the system 10 by way of input transformer 29 which has a primary winding 30 connectable over contacts THS of a thermostat (not shown) to a source of 120 VAC, 60 Hz voltage. Transformer 29 has a secondary winding 31 which is connected between a pair of conductors 32 and 33. The input transformer 29 is a step down transformer providing 24 VAC, 60 Hz voltage between conductors 32 and 33.

The pulse generating circuit 11 includes a high voltage transformer having a primary winding 38 and secondary winding 39, a pair of capacitors 36 and 37, and a silicon controlled rectifier 35.

Capacitors 36 and 37 are connected for operation as a voltage doubler circuit. A charging path for capacitor 36 is provided from conductor 33 over diode 40 to one side of the capacitor 36 at point 41. The other side of the capacitor 36 is connected to conductor 32. Capacitor 36 at point 41 is connected over a resistor 42 and a diode 43 to one side of capacitor 37 at point 44. The other side of capacitor 37 at point 45 is connected over a diode 46 and a resistor 47 to conductor 33.

The primary winding 38 of the transformer is connected between point 44 and the anode of the silicon controlled rectifier 35. The cathode of the silicon controlled rectifier 35 is connected to point 45 so that capacitor 37 is effectively connected in shunt with the primary winding 38 of the transformer and silicon control rectifier 35. The silicon controlled rectifier 35 has a gate electrode connected over a resistor 48 to conductor 33. A resistor 49 is connected between the gate electrode and the cathode electrode of the silicon controlled rectifier 35.

The voltage doubler capacitors 36 and 37 are charged by the line potential to provide current flow over a primary winding 38 of the ignition transformer and silicon controlled rectifier 35 whenever the silicon controlled rectifier 35 is conductive. The current flow through the primary winding 38 of the ignition transformer induces voltage pulses in the secondary winding 39 of the ignition transformer which has one end at point 50 connected to electrode **12*a* and another end at point 51 connected over a capacitor 52 and a diode 53 to conductor 33. The other ignition electrode 12*b* of the ignition electrode pair 12 is connected directly to conductor 32. The electrodes 12*a* and 12*b* are spaced apart providing a gap there between so that whenever a voltage pulse is induced in secondary winding 39, a spark is generated between the electrodes 12*a* and 12*b***.

The electrodes 12*a* and 12*b* are positioned adjacent the outlet 13 of the pilot burner 14 to permit ignition of the pilot fuel by the ignition sparks.

The pulse generating circuit 11 also controls the energization of the control circuit 18. The control circuit 18 includes a silicon controlled rectifier 55 which is rendered conductive in response to the flow of charging current for capacitor 37 to provide an energizing current path for the warp switch heater 22 and the pick-up winding 19 of the pilot valve 17.

The pick-up winding 19 is connected from conductor 32 over normally closed warp switch contacts 23, and over redundant diodes 60 and 61 to the anode of the silicon controlled rectifier 55. The cathode of the silicon controlled rectifier 55 is connected to conductor 33.

The warp switch heater 22 is connected from conductor 32 over a diode 58 and diode 61 to the anode of the silicon controlled rectifier 55. A further energizing path is provided for the warp switch heater 22 over the gate-cathode circuit of silicon controlled rectifier 35. This path extends from conductor 33 over resistor 48, the gate-cathode circuit of silicon controlled rectifier 35, the resistor 63 and the warp switch heater 22 to conductor 32. This path is used for proving the continuity of the warp switch heater 22 as is described hereinafter.

Whenever silicon controlled rectifier 35 is being rendered conductive by the negative half cycle of the line voltage, when conductor 32 is negative with respect to conductor 33, silicon controlled rectifier 55 is in turn being rendered conductive during the positive half cycle of the line voltage and accordingly, the pilot valve 17 and the warp switch heater 22 are energized.

When ignition of the pilot fuel emanating from the pilot burner 14 is accomplished, the pilot flame bridges the gap between the ignition electrodes 12*a* and 12*b*. The presence of the pilot flame is sensed by the sensing circuit 24 which includes a transistor 66, resistor 67 and capacitor 52. The base of transistor 66 is connected over resistor 67 and capacitor 52 to one end of the secondary winding 39 of the ignition transformer at point 51. The emitter of transistor 66 is connected to conductor 33 and the collector of transistor 66 is connected to the cathode of silicon controlled rectifier 35 and over resistor 63 and heater 22 to conductor 32.

Whenever a pilot flame bridges the gap between the electrodes 12, current flow through capacitor 52 establishes a charge on capacitor 52. Transistor 66, which is normally non-conducting, is rendered conductive in response to the subsequent discharge of capacitor 52 effecting the cut-off of silicon controlled rectifier 35 and correspondingly inhibiting of the generation of further voltage pulses while transistor 66 remains conducting. The operation of transistor 66 to inhibit the pulse generator circuit 11 defines a sampling period during which time silicon controlled rectifiers 35 and 55 are cut-off. When the discharge current of capacitor 52 drops below the value required to maintain transistor 66 conducting, transistor 66 cuts-off to permit conduction of silicon controlled rectifiers 35 and 55.

The sampling circuit 26 includes a silicon controlled rectifier 69, a capacitor 70 and resistors 71 and 72. The hold winding 20 is connected between conductor 32 and the anode of silicon controlled rectifier 69. The cathode of silicon controlled rectifier 69 is connected to conductor 33. A capacitor 73 and a diode 74 are individually connected in parallel with winding 20. The pick-up winding 27 of the main burner valve 16 is connected from conductor 32 over capacitor 75 to the anode of silicon controlled rectifier 69. The hold winding 28 of the main burner valve 16 is connected in parallel with capacitor 75.

The gate of silicon controlled rectifier 69 is connected over capacitor 70 and resistor 71 to the anode of silicon controlled rectifier 55. The gate of silicon controlled rectifier 69 is also connected over resistor 72 to conductor 33.

Capacitor 70 is charged and discharged in accordance with the operation of silicon controlled rectifier 55 providing gate current for silicon controlled rectifier 69. When silicon controlled rectifier 69 is conductive, an energizing path is provided for pilot valve hold winding 20 and main burner valve pick-up winding 27 and hold winding 28. Capacitor 75 provides an inrush current through pick-up winding 27 of the main burner valve 16 to cause the valve 16 to open, and hold winding 28 maintains the main burner valve open.

Operation of the Pilot Ignition System

Assuming initially the pilot valve is closed cutting off the flow of fuel to the system, when the thermostat contacts THS are closed, the 120 VAC line voltage is applied to the primary winding 30 of the input transformer 29 generating 24 VAC in the secondary winding 31, which voltage is applied to conductors 32 and 33. When conductor 33 is positive with respect to conductor 32, current flows over diode 40 to voltage doubler capacitor 36 which charges to the line voltage +24 VAC. In the next half cycle, when conductor 32 is positive with respect to conductor 33, the voltage on capacitor 36 is transferred to capacitor 37 over resistor 42 and diode 43. The next half cycle, when conductor 33 is positive with respect to conductor 32, current flows from conductor 33 over resistor 48 to the gate of silicon controlled rectifier 35 and over the cathode of silicon controlled rectifier 35, resistor 63 and warp switch heater 22 to conductor 32. This flow of gate current renders silicon controlled rectifier 35 conductive, providing a discharge path for capacitor 37 over the primary winding 38 of the ignition transformer and the anode to cathode circuit of silicon controlled rectifier 35.

The flow of current through the primary winding 38 of the ignition transformer induces a high voltage pulse in the secondary winding 39 causing an ignition spark to bridge the gap between the electrodes 12*a* and 12*b*. The ignition spark ignites fuel emanating from the pilot burner 14 whenever the pilot valve 17 is operated.

During the half cycle of the line voltage when capacitor 37 is charging current flows over diode 46 and resistor 47 to conductor 33. The voltage drop across resistor 47 is extended over resistor 56 to the gate of silicon controlled rectifier 55 of the control circuit 18. Accordingly, silicon conrolled rectifier 55 conducts permitting current to flow from conductor 32 through the pick-up coil 19 of the pilot valve 17 over the normally closed warp switch contacts 23, and redundant diodes 60 and 61 to the anode to cathode circuit of the controlled rectifier 55 to conductor 43. Accordingly, the pilot valve 17 is operated supplying fuel to the pilot burner 14.

When silicon controlled rectifier 55 is conducting, a high current path is provided for the warp switch heater 22 from conductor 32 over the warp switch heater 22 diode 58, diode 61, and silicon controlled rectifier 55 to conductor 33. Thus, when silicon controlled rectifier 55 is conducting, the pilot valve 17 is operated and the warp switch heater 22 in energized. If ignition of the fuel does not occur within a predetermined time, the warp switch heater 22 causes associated contacts 23 to operate, deenergizing the pick-up winding 19 and permitting the pilot valve 17 to close to shut off the supply of fuel to the system.

If the pilot gas is ignited, the sensing circuit 24 senses the presence of the pilot flame. Thus, assuming a pilot flame is established between the electrodes 12, when the end of the secondary winding 39 is connected to the capacitor 52 at point 51 is positive with respect to the end of the winding 39 connected to the electrode 12*a* at point 50, current flows through capacitor 52 and diode 53 to conductor 33 and then over the secondary winding 31 of the input transformer 29 to conductor 32 over the electrode 12*b*, the flame to electrode 12*a* to point 50. Accordingly, capacitor 52 is charged with the polarity indicated in the drawing. As soon as capacitor 52 is charged, capacitor 52 begins to discharge in a reverse path over the secondary winding 39 through the flame to conductor 32, thence over secondary winding 31 of the input transformer, conductor 33 to the emitter of transistor 66 to the base of transistor 66 and over resistor 67 to capacitor 52.

The discharge current flowing the emitter-base circuit of transistor 66 causes transistor 66 to be rendered conductive, by-passing the gate current around silicon controlled rectifier 35 causing silicon controlled rectifier 35 to stop conducting. Accordingly, further pulse generation is temporarily inhibited and sparking at the electrodes 12 ceases.

After the discharge current of capacitor 52 drops below the value required to maintain transistor 66 conducting, transistor 66 is cut-off permitting gate current to flow to silicon controlled rectifier 35 to re-initiate the generation of high voltage pulses in the secondary winding 39 of the ignition transformer 39.

The high voltage pulses generated in the secondary winding 39 again cause capacitor 52 to charge which in turn discharges in the manner described above to render transistor 66 conductive disabling silicon controlled rectifier 55 and inhibiting sparking. This pulsing operation continues as long as the pilot flame is established. The charging time of capacitor 52 is short relative to the discharge time of the capacitor 52. Accordingly, the silicon controlled rectifier 35 and consequently silicon controlled rectifier 55 are pulsed into conduction at a pulse rate such that the sampling period during which silicon controlled rectifiers 35 and 55 are non-conducting is greater than the spark generation period.

During the period while silicon controlled rectifiers 35 and 55 are maintained cut off, the average current through the warp switch heater 22 and the pilot valve pick-up winding 19 is maintained at a low value such that heating of the warp switch heater 22 is negligible whenever the pilot flame is established.

Prior to the establishment of a pilot flame, the pilot valve hold winding 20 and the main burner valve pick-up winding 27 and hold winding 28 are deenergized and silicon controlled rectifier 69 is non-conducting. Once the pilot flame is established and the flame sensing circuit 24 is operative to periodically render silicon controlled rectifiers 35 and 55 non-conductive as described above, silicon controlled rectifier 69 is enabled to effect energization of the pilot valve hold winding 20 and the main burner valve windings 27 and 28.

When silicon controlled rectifier 55 is cutoff, gate current is supplied to silicon controlled rectifier 69 of the sampling circuit 26 over a path extending from conductor 32, pilot valve pick-up winding 19, warp switch contacts 23, diodes 60 and 61, resistor 71 and capacitor 70 to the gate of silicon controlled rectifier 69. The charging current of capacitor 70 causes silicon controlled rectifier 69 to conduct. When silicon controlled rectifier 69 is rendered conductive, the pilot valve hold winding 20 is energized.

Conduction of silicon controlled rectifier 69 also establishes an energizing path for the pick-up winding 27 and hold winding 28 of the main burner valve 16. The pick-up coil 27 has a low resistance of approximately 16 ohms. Accordingly, when silicon controlled rectifier 69 is enabled, current supplied by capacitor 75, which is charged by the line voltage, causes rapid energization of the pick-up winding 27 enabling the main burner valve 16 to operate.

The hold winding 28, which energized maintains the main burner valve 16 operated the holding winding 28 has a relatively high resistance, on the order of approximately 700 ohms. The high resistance of the hold winding 28 prevents overheating of the windings 27 and 28. Therefore, the high power inrush provided by capacitor 75 which energizes pick-up winding 27 permits rapid operation of the main burner valve 16 while the steady state power input to the pick-up winding 27 and the holding 28 is decreased.

Both the pilot valve 17 and the main burner valve 16 are held energized whenever silicon controlled rectifier 69 is conducting. Silicon controlled rectifier 69 is rendered conductive in response to the charging current of capacitor 70. The charging rate for capacitor 70 is determined by the flame sensing circuit 24 which periodically renders silicon controlled rectifiers 35 and 55 non-conductive during the sampling period as described above. When a pilot flame is established silicon controlled rectifier 55 is pulsed into conduction at a pulse rate the timing of which is sufficient to permit capacitor 70 to discharge periodically over resistor 71 and silicon controlled rectifier 55 and resistor 72 to conductor 33. Under such conditions, silicon controlled rectifier 69 continues to conduct. If, however the pulse generating circuit 11 becomes inoperative, causing a loss of spark at the electrode 12, or if there is leakage across the electrodes 12*a* and 12*b*, the loss of spark causes silicon controlled rectifier 55 to be cut-off permitting capacitor 70 to charge to the line potential of 24 volts such that gate current is no longer supplied to silicon controlled rectifier 69. Accordingly, silicon controlled rectifier 69 is cut-off, deenergizing pilot valve hold windings 27 and 28 thereby shutting off both the pilot valve 17 and the main burner valve 16. It is pointed out the pilot valve pick-up winding 19 is also deenergized when silicon controlled rectifier 55 is non-conducting.

Whenever the pilot flame is extinguished, transistor 66 is rendered non-conductive, instantly, causing energization of silicon controlled rectifier 35 to effect generation of further ignition sparks to reestablish the pilot flame. In addition, silicon controlled rectifier 55 begins conducting to energize the warp switch heater 22 as described above. When silicon controlled rectifier 55 becomes conductive, the gate of silicon controlled rectifier 69 is effectively grounded, causing silicon controlled rectifier 69 to be cut-off. Thus, the pilot valve hold winding 20 and the main burner valve winding 27 and 28 are deenergized. Accordingly, the main burner valve 16 closes. However, although the hold winding 20 of the pilot valve 17 is deenergized, the pilot valve 17 does not drop out because the pick-up winding 19 is energized whenever silicon controlled rectifier 55 is conducting.

Accordingly, the pilot fuel ignition system 10 comprises a fail-safe circuit which responds to loss of spark and loss of pilot flame to effect total shutoff of the fuel supply to the system. The circuit is self-checking in that the operability of the pulse generator 11 is periodically tested by way of the sampling circuit 26. In the event of loss of spark for any reason, including leakage between the electrodes 12, the sampling circuit 26 effects disabling of the pilot valve hold winding 20 and the main burner pick-up winding 27 and hold winding 28 to provide total shutoff of fuel to the system.

In addition to testing the operability of the pulse generating circuit 11, the pilot ignition system 10 of the present invention also tests the continuity of the warp switch heater 22. In case of loss of pilot flame, the warp switch heater 22 effects deenergization of the pilot valve 17 thereby interrupting the flow of fuel to the main burner 16 as well as to the pilot burner 14. To enable silicon controlled rectifier 35 to conduct when conductor 33 is positive with respect to conductor 42, gate current must flow over the gate to cathode circuit of the silicon controlled rectifier 35. As can be seen in the drawing, the only path for gate current is from conductor 33, over resistor 48, the gate to cathode circuit of the silicon controlled rectifier 35, resistor 63 and warp switch heater 22. Accordingly, if the warp switch heater 22 is open circuit, silicon controlled rectifier 35 will not conduct. Resistor 63 is a large value, such as 27K ohms and the warp switch heater resistance is 55 ohms, for example. Thus, when conductor 33 is positive relative to conductor 32 during one half cycle of the line voltage, the warp switch heater circuit is proven over a low current path, and during the other half cycle of the line voltage silicon controlled rectifier 55 conducts and the large current required for heating flows through warp switch heater 22.

I claim:

1. In a fuel ignition system including at least one valve means operable when energized to supply fuel to a fuel outlet, an ignition circuit for controlling the operation of said valve means and for igniting fuel emanating from said outlet, said ignition circuit comprising ignition means operable to generate ignition sparks in the proximity of said outlet for igniting fuel emanating therefrom to establish a flame, energizing means controlled by said ignition means to energize said valve means, sensing means for controlling the operation of said ignition means, said sensing means being disabled in the absence of a flame at said outlet to enable said ignition means to operate, and said sensing means being enabled whenever a flame is established at said outlet to normally disable said ignition means to inhibit the generation of ignition sparks, said sensing means including timing means for permitting said sensing means to periodically enable said ignition means to operate to generate ignition sparks for a predetermined time while a flame is established, said energizing means being operable to deenergize said valve means whenever said ignition means fails to operate during said predetermined time.

2. A system as set forth in claim 1 which includes means operable whenever the flame is extinguished to disable said energizing means to thereby deenergize said valve means.

3. A system as set forth in claim 1 which includes warp switch means having heating element means connected in an enabling path for said ignition means, said warp switch means having associated contact means connected in an enabling path for said energizing means, said heating element means being energized whenever the flame is extinguished to operate said contact means thereby disabling said energizing means to effect deenergization of said valve means.

4. A system as set forth in claim 3 wherein said energizing means includes first switching means, said first switching means being normally unoperated and being rendered operative periodically during said sampling period to provide an energizing path for said heating element means, said sensing means maintaining said first switching means unoperated for a time sufficient to prevent operation of said warp switch means whenever the flame is established.

5. In a fuel ignition system including at least one valve means operable when energized to supply fuel to a fuel outlet, an ignition circuit for controlling the operation of said valve means and for igniting fuel emanating from said outlet, said ignition circuit comprising ignition means operable when enabled to generate ignition sparks in the proximity of said outlet for igniting fuel emanating therefrom to establish a flame, energizing means controlled by said ignition means to energize said valve means, sensing means enabled whenever a flame is established to normally disable said ignition means during a first period, said sensing means including timing means for establishing a sampling period during which said sensing means enables said ignition means to operate while said flame is established, said ignition means including pulse generating means including switching means, said switching means being normally unoperated during said first period and being operated periodically during said sampling period to effect the generation of ignition sparks, and warp switch means having element means serially connected in an enabling circuit for said switching means whereby said switching means is maintained unoperated during said sampling period in the event of a discontinuity in said enabling circuit including said heating element means, said energizing means being operable to deenergize said valve means whenever said ignition means fails to operate during said sampling period and said warp switch means having associated contact means connected in an enabling path for said energizing means, said heating element means being energized whenever the flame is extinguished to cause said contact means to operate at a predetermined time after the flame is extinguished, thereby disabling said energizing means to effect deenergization of said valve means.

6. In a fuel ignition system including at least one valve means operable when energized to supply fuel to a fuel outlet, an ignition circuit for controlling the operation of said valve means and for igniting fuel emanating from said outlet, said ignition circuit comprising ignition means operable when enabled to generate ignition sparks in the proximity of said outlet for igniting fuel emanating therefrom to establish a flame, energizing means controlled by said ignition means to energize said value means said energizing means including control means operable when enabled to energize a first control winding of said valve means, and sampling means operable when enabled to energize a second control winding of said valve means, said control means being enabled in response to enabling of said ignition means to energize said first control winding to operate said valve means, and said sampling means being enabled when the flame is established to energize said second control winding to maintain said valve means operated, sensing means enabled whenever a flame is established to normally disable said ignition means during a first period, said sensing means including timing means for establishing a sampling period during which said sensing means enables said ignition means to operate while said flame is established, said energizing means being operable to deenergize said valve means whenever said ignition means fails to operate during said sampling period.

7. A system as set forth in claim 6 wherein said sensing means normally disables said control means whenever the flame is established, said control means being enabled during said sampling period, and wherein said sampling means includes switching means and further timing means for controlling the operation of said switching means to maintain said switching means operated for a predetermined time after said control means is disabled.

8. In a fuel ignition system including at least one valve means operable when enabled to supply fuel to a fuel outlet, an ignition circuit for controlling the operation of said valve means and for igniting fuel emanating from said outlet, said ignition circuit comprising ignition means operable when enabled to generate ignition sparks in the proximity of said outlet for igniting fuel emanating therefrom to establish a flame, control means controlled by said ignition means for energizing a first control winding of said valve means for operating said valve means, sampling means responsive to the enabling of said control means for energizing a second control winding of said valve means to maintain said valve means operated, and flame sensing means enabled whenever a flame is established for normally disabling said ignition means and said control means, said flame sensing means including timing means for causing at least said control means to be enabled at a predetermined rate whenever a flame is established to thereby maintain said sampling means operated.

9. In a fuel ignition system including at least one valve means operable when energized to supply fuel to a fuel outlet, an ignition circuit for controlling the operation of said valve means and for igniting fuel emanating from said outlet, said ignition circuit comprising electrode means including a pair of electrodes spaced apart to provide a gap there between, said electrodes being positioned adjacent said outlet, pulse generating means for generating voltage pulses for application to said electrodes to effect the generation of ignition sparks between said electrodes for igniting fuel emanating therefrom whenever said valve means is operated, energizing means controlled by said pulse generating means to energize said valve means, flame sensing means, including said electrodes, for controlling the operation of said pulse generating means, said flame sensing means being disabled in the absence of a flame at said outlet to enable said pulse generating means to generate pulses, and said flame sensing means being enabled whenever a flame bridges the gap between said electrodes for normally disabling said pulse generating means to thereby inhibit the generation of ignition sparks, said sensing means including timing means for periodically enabling said pulse generating means to operate while said flame is established to thereby maintain said energizing means operated, said flame sensing means being disabled whenever the flame is extinguished to enable said pulse generating means to effect the generation of further ignition sparks and to cause said energizing means to effect deenergization of said valve means in the event a flame fails to be reestablished within a predetermined time.

10. A system as set forth in claim 9 wherein said pulse generating means includes current source means, first switching means and ignition transformer means having first and second windings, said first winding being connected in a first circuit path with said current source means and said first switching means, and said second winding being connected in a second circuit path with said electrodes, said first switching means being normally unoperated and being operated periodically to enable current flow over said first winding to induce voltage pulses in said second winding for application to said electrodes.

11. In a fuel ignition system including at least one valve means operable when energized to supply fuel to a fuel outlet, an ignition circuit for controlling the operation of said valve means and for igniting fuel emanating from said outlet, said ignition circuit comprising electrode means including a pair of electrodes spaced apart to provide a gap there between, said electrodes being positioned adjacent said outlet, pulse generating means including current source means, first switching means and ignition transformer means having first and second windings, said first winding being connected in a first circuit path with said current source means and said first switching means, and said second winding being connected in a second circuit path with said electrodes, said first switching means being normally unoperated and being operated periodically to enable current flow over said first winding to induce voltage pulses in said second winding for application to said electrodes to effect the generation of ignition sparks between said electrodes for igniting fuel emanating therefrom whenever said valve means is operated, energizing means controlled by said pulse generating means to energize said valve means, flame sensing means, including said electrodes, enabled whenever a flame bridges the gap between said electrodes for normally disabling said pulse generating means to thereby inhibit the generation of ignition sparks, said flame sensing means including timing means and second switching means controlled by said timing means whenever the flame is established, to be operable to normally maintain said first switching means unoperated during a first period and to permit said first switching means to operate during a second period, to thereby maintain said energizing means operated, said flame sensing means being disabled whenever the flame is extinguished permitting said energizing means to effect deenergization of said valve means after a predetermined time.

12. A system as set forth in claim 11 wherein said timing means includes capacitor means connected in a portion of said second circuit path, said capacitor means being alternately charged and discharged whenever the flame is established to thereby provide an enabling signal for operating said second switching means.

13. A system as set forth in claim 12 wherein the charging time of said capacitor means is short relative to the discharge time of said capacitor means whereby said first period is of a larger duration than said second period.

14. In a fuel ignition system including a first burner means having an associated first valve means operable to supply fuel to said first burner means and a second burner means having an associated second valve means operable to supply fuel to said second burner means, an ignition circuit for controlling the operation of said first valve means and said second valve means and for igniting fuel supplied to said first burner means to enable ignition of fuel supplied to said second burner means, said ignition circuit ignition means operable when enabled to generate ignition sparks in the proximity of said first burner means for igniting fuel emanating from said first burner means to establish a flame whenever said first valve means is operated, control means including first switching means controlled by said ignition means to operate said first valve means, sampling means including second switching means enabled by said control means to maintain said first valve means operated and to operate said second valve means, and sensing means enabled whenever a flame is established to normally disable said ignition means and said first switching means during a first period, said sensing means including timing means for establishing a sampling period during which said sensing means enables said ignition means and said first switching means to operate while said flame is established, said sampling means deenergizing said first valve means and said second valve means whenever said ignition means fails to operate during said sampling period.

15. A system as set forth in claim 14 wherein said first valve means supplies fuel to said second valve means whereby the supply of fuel to said first and second burner means is shut off whenever said first valve means is unoperated.

16. A system as set forth in claim 15 which includes warp switch means operable whenever the flame is extinguished to disable said first switching means thereby disabling said first valve means to shut off the supply of fuel to said first and second burner means.

17. A system as set forth in claim 14 wherein said first valve means includes first and second control windings, said first control winding being connected in an energizing path with said first switching means and said second winding being connected in an energizing path with said second switching means, said first switching means being enabled by said ignition means to energize said first control winding for operating said first valve means and said second switching means being enabled in response to enabling of said first switching means to energize said second control winding to maintain said first valve means operated.

18. A system as set forth in claim 17 wherein said second valve means includes third and fourth control windings connected in further energizing paths with said second switching means and energized whenever said second switching means is enabled to operate said second valve means.

19. In a fuel ignition system including at least one valve means operable when energized to supply fuel to a fuel outlet, an ignition circuit for controlling the operation of said valve means and for igniting fuel emanating from said outlet, said ignition circuit comprising ignition means operable to generate ignition sparks in the proximity of said outlet for igniting fuel emanating therefrom to establish a flame, energizing means controlled by said ignition means to energize said valve means, sensing means for controlling the operation of said ignition means, said sensing means being disabled in the absence of a flame at said outlet to enable said ignition means to operate, and said sensing means being enabled whenever a flame is established at said outlet to cause said ignition means to be disabled to inhibit the generation of ignition sparks, said sensing means including timing means for periodically enabling said ignition means for a first predetermined time while a flame is established, said energizing means being responsive to the periodic enabling and disabling of said ignition means while a flame is established to maintain said valve means operated, and means for disabling said energizing means for causing said valve means to be deenergized whenever said flame sensing means remains disabled, permitting said ignition means to operate, for a second predetermined time which is greater than said first predetermined time.

20. In a fuel ignition system including at least one valve means operable when energized to supply fuel to a fuel outlet, an ignition circuit for controlling the operation of said valve means and for igniting fuel emanating from said outlet, said ignition circuit comprising ignition means operable when enabled to generate ignition sparks in the proximity of said outlet for igniting fuel emanating therefrom to establish a flame, energizing means operable when enabled to energize said valve means, deactivating switch means including contact means and heating element means operable when energized for a predetermined time to effect the deenergization of said valve means, flame sensing means enabled when a flame is established at said outlet to cause said energizing means to prevent said deactivating switch means from effecting the deenergization of said valve means, said energizing means being operable when a flame is established to periodically energize said heating element means for a time less than said predetermined time to test the continuity of said heating element means, said energizing means being inhibited to permit said valve means to be deenergized in the event of a discontinuity for said heating element means.

* * * * *